US005519927A

United States Patent [19]

Roessler

[11] Patent Number: 5,519,927

[45] Date of Patent: May 28, 1996

[54] RIVET SETTING TOOL

[75] Inventor: Andreas Roessler, Milford, Conn.

[73] Assignee: Emhart Inc., Newark, Del.

[21] Appl. No.: 421,590

[22] Filed: Apr. 12, 1995

[51] Int. Cl.[6] ..... B21J 15/34

[52] U.S. Cl. ..... 29/243.523; 29/243.525; 72/391.6

[58] Field of Search ..... 29/243.521, 243.522, 29/243.523, 243.524, 243.525; 72/391.4, 391.7

[56] References Cited

U.S. PATENT DOCUMENTS 4,628,722 12/1986 Mauer et al. ..... 29/243.525
4,630,460 12/1986 Mauer ..... 29/243.525
5,170,923 12/1992 Dear et al. ..... 72/391.6
5,337,463 8/1994 Rossler et al. ..... 29/243.521

FOREIGN PATENT DOCUMENTS 468717 1/1992 European Pat. Off. ..... 29/243.523

*Primary Examiner*—David Jones
*Attorney, Agent, or Firm*—E. D. Murphy

[57] ABSTRACT

A rivet setting tool for use with double headed blind rivets comprises a collet assembly adapted to engage a pulling head of the rivet mandrel and support segments for engaging the rivet. A single piston drive pulls the collet assembly and the mandrel rearwards relative to the support segments and rivet to set the rivet. Continued movement of the piston further retracts the collet assembly and the support segments to permit delivery of a new rivet at the front of the tool and returns the collet assembly and support segments to a forward position in engagement, respectively, with the mandrel head and the rivet.

7 Claims, 3 Drawing Sheets

RIVET SETTING TOOL

BACKGROUND OF THE INVENTION

The present invention is concerned with riveting tools for use in setting blind rivets of the type which comprise a tubular rivet having a head, and a mandrel which passes through the tubular rivet and comprises a setting head which engages an end face of the tubular rivet remote from its head and a pulling head which is pulled to move the mandrel relative to the rivet to set it. Such rivets are commonly referred to as "double headed rivets".

A tool for setting a double headed rivet requires a nose piece supporting a pulling assembly, adapted to grip the pulling head of the mandrel to pull the rivet to set the rivet, and an abutment assembly arranged to engage the head of the rivet during its setting. It is necessary that the abutment assembly is capable of moving into an open position to allow the passage of the pulling head of the mandrel past the abutment assembly to engage the pulling assembly and then into a closed position to provide an abutment to engage the head of the rivet.

In a known riveting tool for use with double headed rivet, described in U.S. Pat. No. 4,628,722 the abutment assembly comprises a plurality of abutment members extending generally axially of the nosepiece around the pulling assembly and movable between an open position, in which the pulling head of the mandrel may be passed through the abutment assembly to be engaged by the pulling assembly and a closed position in which the abutment members provide an abutment to engage the rivet head. The abutment members are moved radially between their open and closed positions by a sleeve which is moved axially of the tool by a pneumatic piston and cylinder arrangement. This piston and cylinder arrangement is actuated by a sensor which detects when a rivet has been positioned in the pulling assembly and then causes the abutment members to close. This construction is somewhat complex and expensive particularly in that two separate drive pistons are required.

Another riveting tool for use with double headed rivets, described in U.S. Pat. No. 5,337,463, includes a pulling assembly arranged to grip the pulling head of a mandrel to set the rivet and an abutment assembly extending generally axially around the pulling assembly and movable between an open position, in which the pulling head of the mandrel may be passed through the abutment assembly to be engaged by the pulling assembly, and a closed position in which the abutment members provide an abutment to engage the rivet head. The abutment members are mounted for axial movement against spring pressure and comprise cam means which on such axial movement cause the abutment members to move from their open to their closed positions. The pulling assembly comprises a collet assembly comprising collet members having latches adapted to engage behind the head of a mandrel. When a blind rivet is presented axially to the tool, the head of the rivet engages the abutment members and, when the rivet is pushed into the tool so that the pulling head of the mandrel is engaged by the latches of the collet members, the abutment members are moved axially relative to the nosepiece to move from their open to their closed position, and close firmly about the mandrel. This design is primarily suited for use with rivets fed by hand or from an external rivet presentation device.

It is an object of the present invention to provide a riveting tool for use with double headed rivets which is simpler and more economical in construction.

It is another object of this invention to provide a riveting tool for use with double headed rivets which is adapted for use with an automatic rivet loading system.

BRIEF DESCRIPTION OF THE INVENTION

The present invention provides a riveting tool for use in setting blind rivets which comprise a tubular rivet having a head and a mandrel which passes through the tubular rivet and comprises a setting head, which engages an end face of the rivet, and a pulling head which is pulled to move the mandrel relative to the rivet to set it. The tool includes a nosepiece, a pulling assembly, mounted in the nosepiece and arranged to grip the pulling head of a mandrel, which is attached to a piston for movement relative to the nosepiece to pull the mandrel to set the rivet, and an abutment assembly mounted in the nosepiece and arranged to engage the head of the rivet during its setting and comprising a plurality of abutment members extending generally axially of the nosepiece around the pulling assembly and movable between an open position, in which the pulling head of the mandrel may be passed through the abutment assembly to be engaged by the pulling assembly, and a closed position in which the abutment members provide an abutment to engage the rivet head. In particular accord with this invention, the abutment members are coupled to the pulling assembly for movement relative to the nosepiece after the rivet has been set and cam means are provided to open the abutment members. A new rivet is delivered in front of the abutment members for insertion therebetween during the return stroke of the piston.

BRIEF DESCRIPTION OF THE DRAWINGS

In the accompanying drawings

DETAILED DESCRIPTION OF EMBODIMENT AND DRAWINGS

Figure 1:
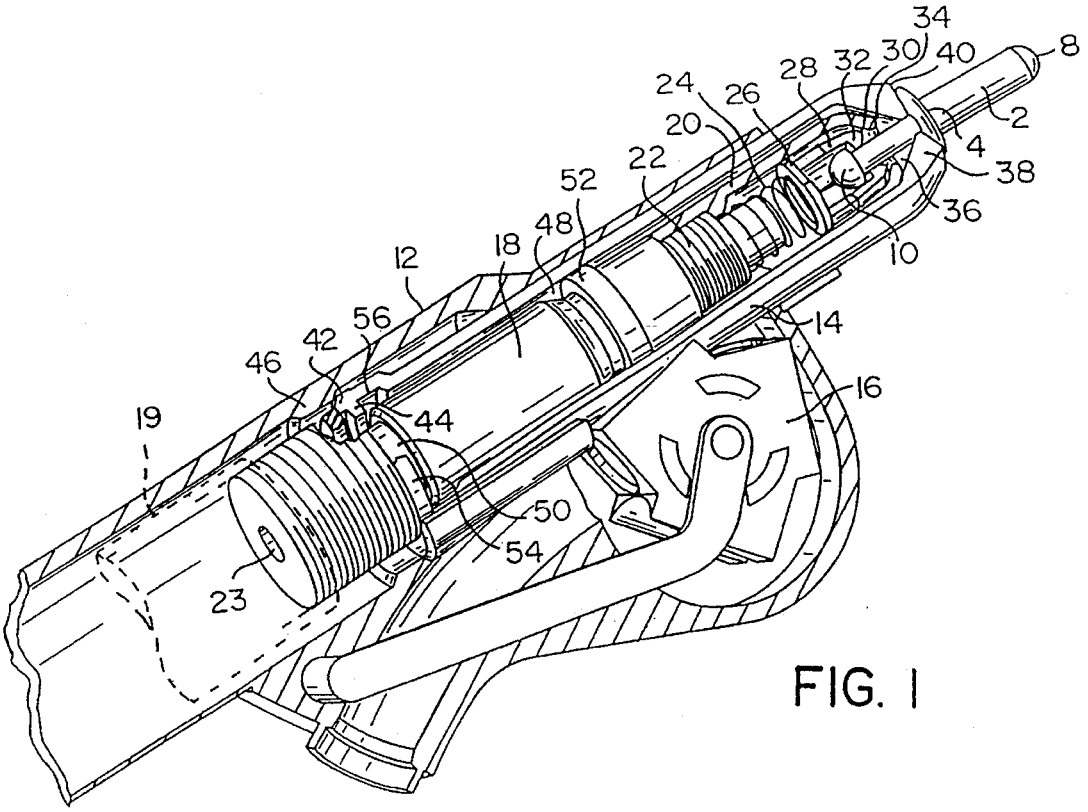
FIG. 1 is a perspective view, partially broken away, of a rivet setting tool in accord with this invention.

The tool according to the invention is a tool for setting blind rivets of the "double headed" type, that is to say blind rivets as shown in FIG. 1 which comprise a tubular rivet 2 having a head 4 and a mandrel 6 which passes through the rivet 2 and which has setting head 8 which engages an end face of the tubular rivet 2 remote from the head 4, and a pulling head 10. It will be understood that the rivet 2 is set by pulling the head 10 while restraining the rivet 2 by engagement of the rivet head 4.

The tool comprises a housing 12 which is fixed to the body of a hydraulic driver (not shown). The housing, shown cut away in FIG. 1, comprises a generally cylindrical body which retains the elements of the pulling and supporting mechanism of the tool. The housing 12 includes a slot 14 through which a feeder mechanism 16 provides a continuous supply of rivets 2. The feeder mechanism 16 is described in detail in my co-pending application serial no. (Docket S4833).

Figure 2:
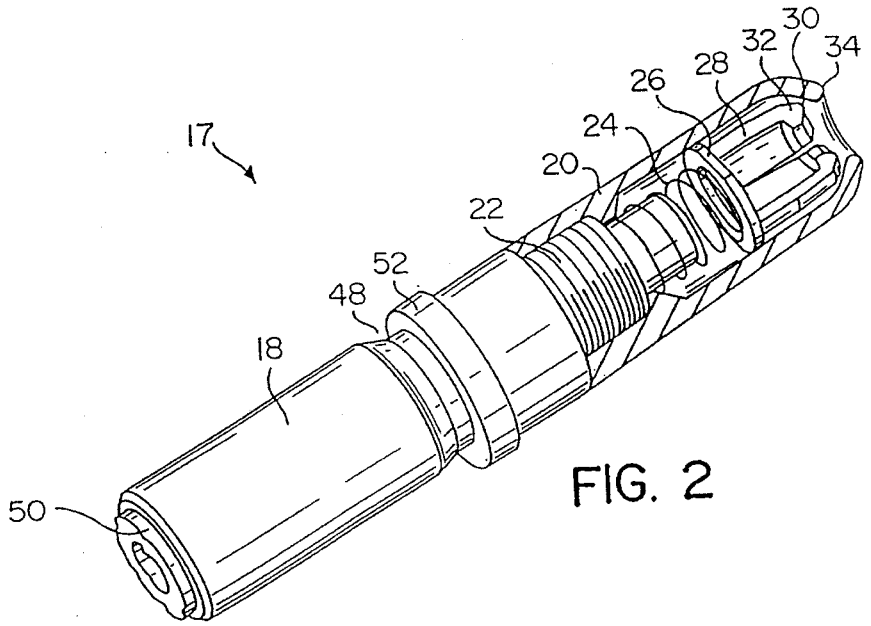
FIG. 2 shows the collet assembly of the tool of FIG. 1.

A pulling collet assembly 17, shown in FIG. 2, is disposed within the housing 12. The collet assembly includes a rear collet member 18 coupled to a piston 19 and a forward collet member 20 which are coupled at the screw threads 22. A tube 23 through the center of the assembly provides for vacuum withdrawal of the broken mandrel in the normal manner. Contained within the forward collet member 20 are a coil spring 24, a washer 26 and a plurality of pulling segments 28, of which two are illustrated. Each pulling segment includes a forward conical surface 30 and a rearwardly facing latch surface 32, the latch surface being adapted to engage behind the head 10 of the mandrel 6. The pulling segments are biased forwardly by the spring 24 so that the conical surfaces 30 are urged against a corresponding internal conical surface 34 at the front end of the forward collet member 20. This biases the segments 28 into a closed or latched position.

An aperture 36 is provided at the front end of the forward collet member 20, the aperture being sized to receive the head 10 of the mandrel 6. When the mandrel is introduced into the collet assembly, the pulling segments 28 are pressed rearwardly and outwardly until the head 10 passes beyond the latch surfaces 32. The pulling segments then return to their forward position, thus locking the mandrel head within the collet.

A plurality of support segments 38 are provided which surround the collet assembly and are retained by the housing 12. The forward end of each support segment 38 ends in an external face 40 which may be flat or, if desired, may be somewhat concave to better accommodate the head 4 of the rivet 2 when the rivet is in place. The rearward end of each support segment 38 comprises an outwardly extending cam 42 and an inwardly extending tooth 44. In the position shown in FIG. 1, the outwardly extending cam 42 engages an inwardly extending cam 46 on the inside surface of the housing 12. The teeth 44 rest against a resilient washer 54 located in groove 50 so that the cam surfaces 42 and 46 initially prevent the support segments from moving when the collet assembly is retracted. As the collet assembly 17 moves further to pull the mandrel 6 and set the rivet 2, the inwardly extending tooth 44 cooperates with grooves 48 and 50 and flange 52 formed on the outer surface of the rear collet member 18 in a manner which will now be described.

The setting tool as shown in FIG. 1 is configured to set the rivet 2 in a workpiece which is not shown. The setting tool is operable by means of a conventional hydraulic driver, for example of the type shown in U.S. Pat. No. 4,598,571, which culminates in a hydraulically operated piston. The piston is coupled to the rear end of the rear collet member 18. When it is desired to set the rivet 2, the hydraulic piston is operated and moves rearwardly, thus drawing with it the collet assembly. Since the cam surface 42 of the support segments 38 is held outwardly in engagement with cam surface 44 by means of the silicone washer 54 in groove 50 and by the external surface of the rear collet member 18 between the two grooves 48 and 50, the support segments 38 remain stationary during the initial movement of the collet assembly. Accordingly, the mandrel 6 is pulled relative to the rivet 2 until the setting head 8 sets the rivet and the mandrel 6 breaks in conventional manner.

Figure 3:
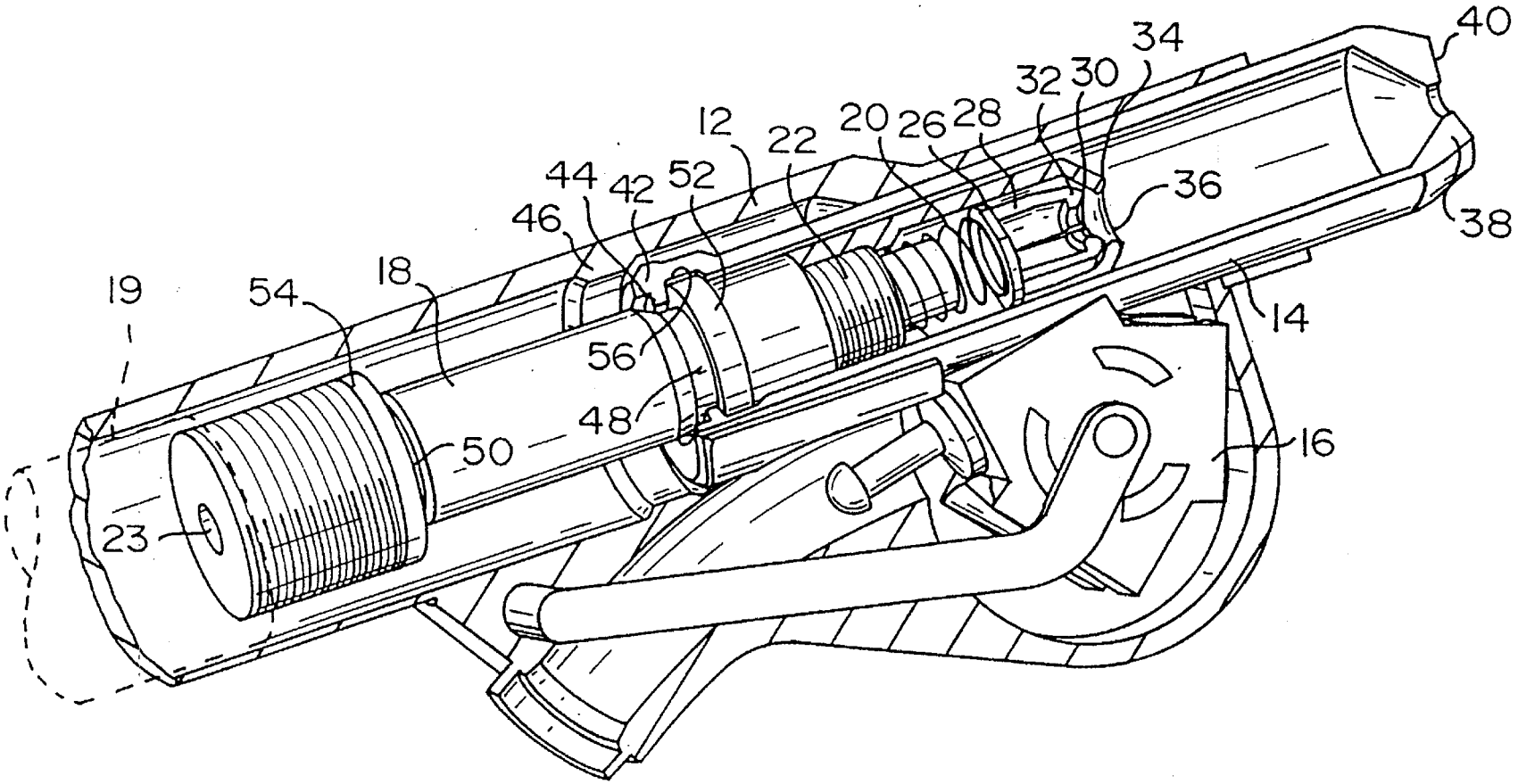
FIG. 3 shows the tool of FIG. 1 in a second position.

After the rivet has been set, the collet assembly continues to move rearwardly until the tooth 44 of the support segments 38 becomes aligned with the groove 48 as shown in FIG. 3. Due to the cams 42 and 46, the rear end of the support segments 38 move radially inward as the teeth 44 enter the groove 48. The enlarged diameter of the flange 52 is accommodated by an enlarged inner-diameter 56 on the inner surface of the support segments immediately forward of the teeth 44.

As shown in FIG. 3, the flange 52 is now engaged with the facing surface 58 of the teeth 44. The cams 42 and 44 disengage and continued rearward motion of the collet assembly drives the support segments rearwardly so that they enter fully within the housing 12 and are moved behind the rearward end of the slot 14 in housing 12. When the inside of the housing adjacent the slot 14 is empty, the feeder mechanism 16 operates to enter the housing 12 and presents a new rivet in front of the support segments 38.

Figure 4:
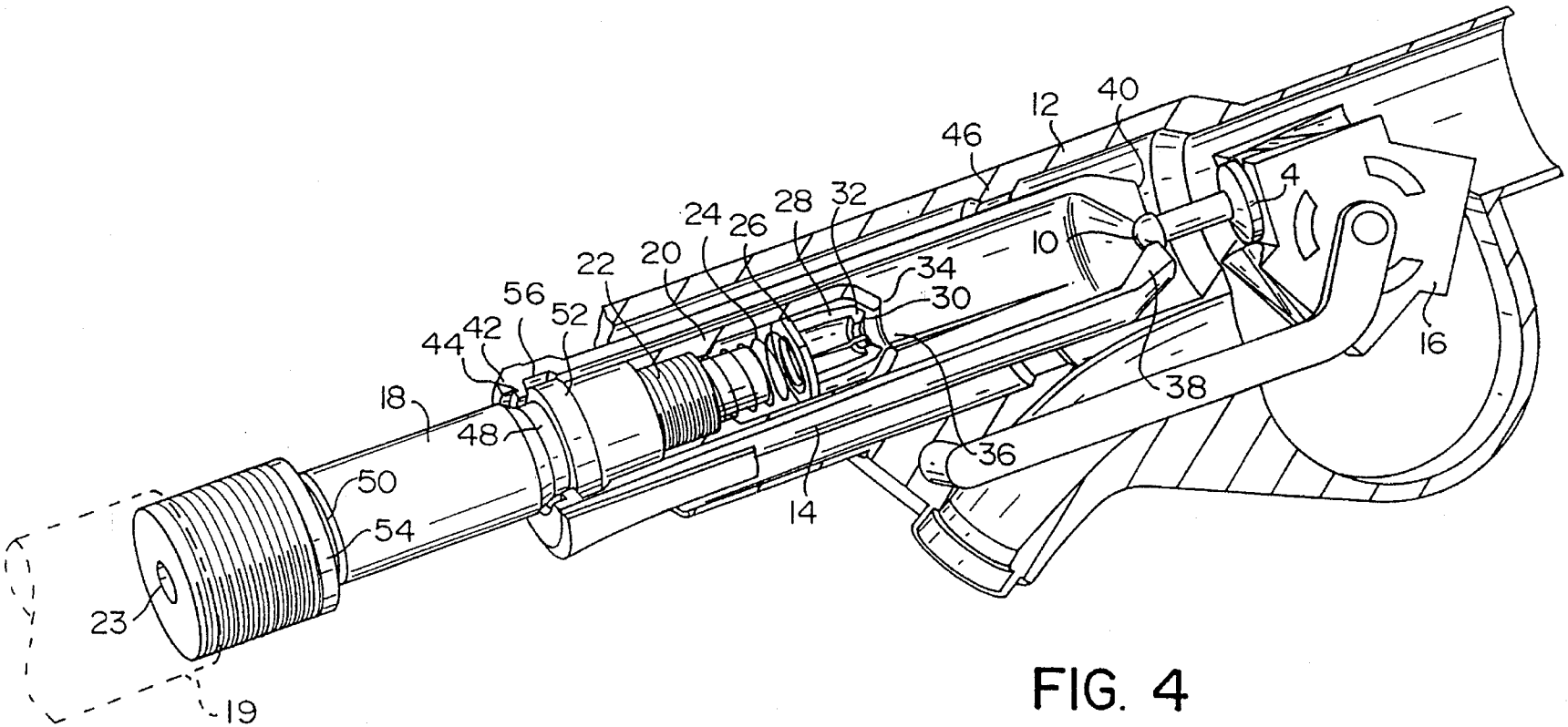
FIG. 4 shows the tool of FIG. 1 in a third position.

After the feeder enters the housing 12, the forward motion of the collet assembly begins, producing the position illustrated in FIG. 4. As shown, the support segments move forward past a head 10 of the mandrel until they encounter the flange or head 4 of the rivet. Continued forward motion of the collet assembly lifts the teeth 44 out of the groove 48 and the collet assembly moves forward relative to the support segments.

When the pulling segments 28 reach the head 10, the spring 24 is compressed, allowing the pulling segments to move back relative to forward collet member 20. The pulling segments open, admitting the head 10. As soon as the head passes far enough into the pulling segments, the spring 24 and washer 26 drive the segments forward against the internal surface 34 of member 20 so that the latching surfaces 32 engage behind the head 10.

Further movement of the collet assembly 17 brings the resilient washer 54 in contact with the tooth 44 at the rear of the support segment 38. Further forward motion of the collet assembly and support segments now begins to rotate and pivot the feeder mechanism 16, moving it out of the housing 12 as is more completely set forth in the co-pending application previously mentioned. As the supporting segment is carried forward by the flange 52, the resilient washer 54 compresses to permit the cam 42 to pass under the cam 46. As the feeder moves out of the housing 12, the collet assembly and support segments resume the position shown in FIG. 1, ready to present and set the next rivet in a new workpiece.

While a specific construction of this invention has been described, alternative structures embodying the same design concept could also be used. For example, the stop means formed by cam 46 could be provided by a spring-biased stop ring mounted in the housing. A suitably positioned cam on the collet assembly could then be used to drive the stop ring out of the path of the support segments after breakage of the mandrel. This construction also enables the use of a single drive piston to reciprocate both the collet assembly and the support segments.

It will be understood that the construction of this tool is comparatively simple and inexpensive. It is further readily adapted to use with various types of automatic feeders such as that illustrated in the previously identified copending application so that the tool can be operated by hand or machine to rapidly present and set double headed rivets of the type described. The scope of the appended claims is not intended to be limited to the precise details described above, but to encompass all variations which are included within the spirit and scope of this invention.

What is claimed:

1. A rivet setting tool for blind rivets having an enlarged pulling head on a mandrel for setting the rivet comprising:

a housing;

a collet assembly mounted for reciprocation in said housing, said collet assembly including:

pulling segments engaging the mandrel pulling head for pulling the mandrel to set the rivet and break the mandrel during rearward movement of said collet assembly; and a tube for withdrawal of the broken mandrel through said collet assembly;

a plurality of support segments in said housing around said collet assembly for engaging the rivet;

stop means on said housing for preventing movement of said support segments during setting of the rivet;

means for disengaging said stop means after breakage of the mandrel;

drive means on said collet assembly engageable with said support segments for retracting said support segments after disengagement of said stop means to permit delivery of a rivet in front of said support segments and for moving said support segments into engagement with a rivet and said pulling segments into engagement with said mandrel pulling head upon forward movement of said collet assembly.

2. A rivet setting tool as claimed in claim 1 and further comprising a piston for pulling said collet assembly to set the rivet and for reciprocating said collet assembly and said support segments through a rearward position permitting delivery of a rivet in front of said support segments and to a forward position in which said support segments engage the rivet and said pulling segments engage the enlarged pulling head.

3. A rivet setting tool as claimed in claim 1 wherein said drive means is so located on said collet assembly as to engage said support segments immediately upon operation of said disengagement means.

4. A rivet setting tool as claimed in claim 1 wherein said stop means comprises a first cam on said housing and an abutting cam on each of said supporting segments.

5. A rivet setting tool as claimed in claim 4 wherein said disengagement means comprises a recess in said collet assembly, said recess permitting radial separation of said first cam and said abutting cams.

6. A rivet setting tool as claimed in claim 5 wherein said drive means is located adjacent said recess.

7. A rivet setting tool for blind rivets having an enlarged pulling head on the mandrel for setting the rivet comprising:

a housing;

a piston mounted for reciprocation within said housing;

a pulling assembly coupled to said piston, said pulling assembly comprising a tubular member extending forward from said piston and having a cylindrical portion, a reduced diameter portion and a flange portion; and a collet for receiving the enlarged mandrel pulling head located forwardly of said flange portion; and a support assembly comprising a plurality of support segments surrounding said pulling assembly, each of said segments having a forward end for engaging a rivet flange during setting and a rearward end having an inwardly projecting finger and an outwardly extending first cam;

said housing including an inwardly extending second cam positioned to abut said first cam and hold said support assembly against the rivet flange during setting, said first and second cam cooperating to move said fingers into said reduced diameter portion to open said abutment segments after setting and to permit retraction of said abutment assembly by engagement of said flange portion with said fingers.

* * * * *